United States Patent [19]

Minard

[11] 4,101,104

[45] Jul. 18, 1978

[54] UTILITY KNOB

[75] Inventor: Marguerite F. Minard, Wenatchee, Wash.

[73] Assignee: The Raymond Lee Organization, Inc., New York, N.Y.

[21] Appl. No.: 750,470

[22] Filed: Dec. 14, 1976

[51] Int. Cl.[2] ..... A47F 5/00

[52] U.S. Cl. ..... 248/95; 248/205 A; 248/467

[58] Field of Search ..... 248/205 A, 467, 497, 248/311.3, 95; 211/55; 24/30.5 S, 255 BS

[56] References Cited

U.S. PATENT DOCUMENTS

| | | | |
|---|---|---|---|
| 2,451,194 | 10/1948 | Braun | 248/205 A |
| 3,255,987 | 6/1966 | Gatch | 211/59.1 X |
| 3,273,769 | 9/1966 | Miller | 24/255 BS |
| 3,300,164 | 1/1967 | Welles | 248/95 |
| 3,300,173 | 1/1967 | Kennedy | 248/467 |
| 3,616,622 | 11/1971 | Friedman | 248/95 X |

FOREIGN PATENT DOCUMENTS

| | | | |
|---|---|---|---|
| 1,391,820 | 2/1965 | France | 248/205 A |

*Primary Examiner*—Roy D. Frazier
*Assistant Examiner*—Peter A. Aschenbrenner
*Attorney, Agent, or Firm*—Howard I. Podell

[57] ABSTRACT

A knob which may be readily fastened to a flat surface for retention of a detachable litter bag. A shaft of circular cross-section is joined at one end to a first circular disc, concentric with the shaft, and at the other end to a second and smaller concentric circular disc. The external flat surface of the first disc is coated with a self-adhering material, with the edges of the second disc being rounded to permit the second disc to slide through a slotted hole in a tab of a litter bag.

1 Claim, 5 Drawing Figures

UTILITY KNOB

SUMMARY OF THE INVENTION

My invention is a knob which may be readily fastened to a flat surface for retention of a detachable litter bag. A shaft of circular cross-section is joined at one end to a first circular disc, concentric with the shaft, and at the other end to a second and smaller concentric circular disc. The external flat surface of the first disc is coated with a self-adhering material, with the edges of the second disc being rounded to permit the second disc to slide through a slotted hole in a tab of a litter bag.

The knob may be readily fastened to a vertical surface, such as a vehicle dash board.

BRIEF DESCRIPTION OF THE DRAWINGS

The objects and features of the invention may be understood with reference to the following detailed description of an illustrative embodiment of the invention, taken together with the accompanying drawings, in which.

DESCRIPTION OF THE PREFERRED EMBODIMENT

Figure 1:
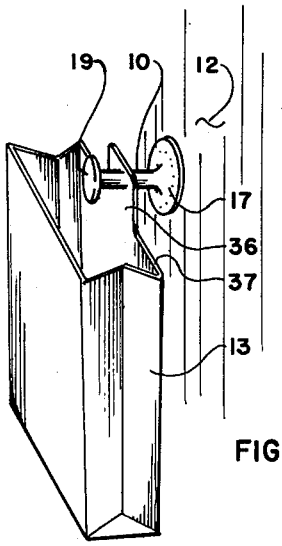
FIG. 1 is a perspective view of the invention in use.
Figure 2:
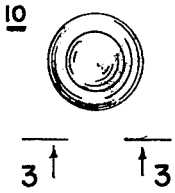
FIG. 2 is an end view of the invention.

Turning now descriptively to the drawings, in which similar reference characters denote similar elements throughout the several views, FIGS. 1–4 illustrate the utility knob 10 which may be readily mounted to a vertical surface 12 to serve as a hanger for retention of a detachable litter bag 13.

Knob 10 is formed of a shaft 15 of circular cross-section, joined at one end to a first concentric disc 17 and at the opposed end to a second concentric disc 19. Discs 17 and 19 lie in parallel planes generally perpendicular to the axis of shaft 15, with disc 17 preferably of a larger diameter than disc 19, and with shaft 15 of a lesser diameter than that of disc 19. A coating 21 of self-adhering bonding material is applied to the external surface 22 of disc 17 for detachably mounting disc 17 to a flat surface, such as vertical surface 12.

Disc 19 is shaped with a rounded convex outer surface 24 that joins a rounded convex inner surface 26 in a continuous rounded convex circular corner edge 27.

Figure 3:
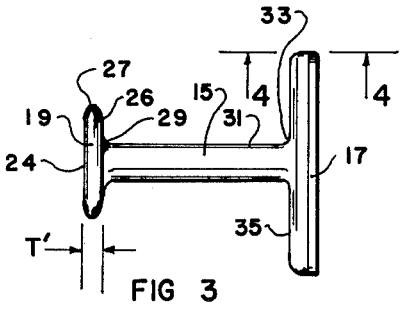
FIG. 3 is a side view of the invention, taken along line 3—3 of FIG. 2.
Figure 4:
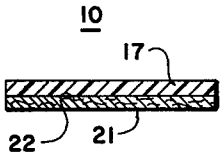
FIG. 4 is a sectional view of the invention, taken along line 4–4 of FIG. 3.
Figure 5:
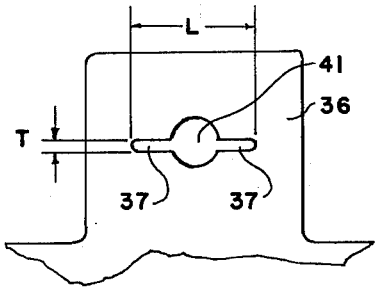
FIG. 5 is a detail side view of the litter bag tab.

The inside corner 29 of inner surface 26 forms a right angle in axial cross-section of the knob, as shown in FIG. 3, to the surface 31 of shaft 15, with the inside corner 33 of inner surface 35 of disc 17 and shaft surface 31 being rounded.

A litter bag 13 is formed with a tab 36 extending beyond a top horizontal edge 37 of bag 13, with tab 36 formed with a through circular hole 41 of a diameter of the general diameter of shaft 15 and with a slot 37 extending from each of two opposed sides of hole 41 and with slots 37 oriented generally parallel to the horizontal edge 37 of bag 13.

The width T of each slot 37 is generally equal to the maximum thickness T′ of disc 19 and the overall length L between the extremities of slots 37 is generally equal to the diameter of disc 19, so that a tab 36 of a litter bag 13 may be readily slipped over disc 19.

The external rounded surfaces of disc 19 prevent inadvertent injury to a person who may inadvertently strike knob 10 when it is mounted to a vehicle dashboard.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A knob for mounting to a flat surface which serves as a hanger for a litter bag, said knob formed of a shaft joined at one shaft end to a first disc and to the opposed shaft end to a second circular disc, with the external surface of the first circular disc coated with a self-adhering plastic material, and with the external surfaces of the second circular disc formed as a continuous convex surface, said disc generally oriented along parallel planes together with a litter bag formed with a tab section, said tab section shaped with a circular hole of substantially the diameter of the diameter of the knob shaft, said hole intersected by a pair of opposed slots that extend a total distance of the general diameter of the second circular knob disc, with the width of each slot being substantially the maximum thickness of the said second circular knob disc, to permit the tab section of the litter bag to be readily detachably mounted to the knob.

* * * * *